US010595586B2

(12) United States Patent
Winefordner et al.

(10) Patent No.: US 10,595,586 B2
(45) Date of Patent: Mar. 24, 2020

(54) MOUNTAIN BIKE SHOE SOLE

(71) Applicant: Crank Brothers, Inc., Laguna Beach, CA (US)

(72) Inventors: Carl Winefordner, Laguna Beach, CA (US); Frank Hermansen, Laguna Beach, CA (US)

(73) Assignee: CRANK BROTHERS, INC., Laguna Beach, CA (US)

( * ) Notice: Subject to any disclaimer, the term of this patent is extended or adjusted under 35 U.S.C. 154(b) by 208 days.

(21) Appl. No.: 15/810,572

(22) Filed: Nov. 13, 2017

(65) Prior Publication Data

US 2019/0142106 A1 May 16, 2019

(51) Int. Cl.

| | |
|---|---|
| ***A43B 5/14*** | (2006.01) |
| ***A43B 3/00*** | (2006.01) |
| ***A43B 13/22*** | (2006.01) |
| ***A43B 1/00*** | (2006.01) |
| ***A43B 13/12*** | (2006.01) |
| ***A43C 15/16*** | (2006.01) |

(52) U.S. Cl.

CPC ..... *A43B 5/14* (2013.01); *A43B 1/0027* (2013.01); *A43B 3/0078* (2013.01); *A43B 13/12* (2013.01); *A43B 13/223* (2013.01); *A43C 15/161* (2013.01)

(58) Field of Classification Search

CPC ..... A43B 5/14; A43B 13/12; A43B 13/223; B62M 3/086

USPC ..... 36/131

See application file for complete search history.

(56) References Cited

U.S. PATENT DOCUMENTS

| | | | | |
|---|---|---|---|---|
| 5,685,093 | A * | 11/1997 | Lin | A43B 1/0054 36/131 |
| 10,342,285 | B2 * | 7/2019 | Aoki | A43B 5/14 |
| 2006/0016102 | A1 * | 1/2006 | Xie | A43B 5/14 36/131 |
| 2006/0080865 | A1 * | 4/2006 | Chao | A43B 5/14 36/131 |
| 2006/0201035 | A1 * | 9/2006 | Signori | A43B 5/14 36/131 |
| 2014/0068880 | A1 * | 3/2014 | Torrance | A43B 5/14 12/146 B |
| 2014/0115748 | A1 * | 5/2014 | Berns | A41D 27/00 2/69 |

* cited by examiner

*Primary Examiner* — Ted Kavanaugh
(74) *Attorney, Agent, or Firm* — Tutunjian & Bitetto, P.C.

(57) ABSTRACT

A mountain bike shoe sole, including an outsole having a lower surface and a tread, and at least a recess, provided in the lower surface, for housing a cleat assembly. The shoe sole further includes at least a removable shim, housed in said recess, suitable to be interposed between the lower surface of the outsole and the cleat assembly.

12 Claims, 8 Drawing Sheets

MOUNTAIN BIKE SHOE SOLE

FIELD OF THE INVENTION

The present invention relates to a mountain bike shoe sole.

More in particular, the invention relates to a mountain bike shoe sole to be used with clip-in bicycle pedals.

BACKGROUND OF THE INVENTION

Mountain bike shoe soles to be used with clip-in pedals typically include a recess in the forward center part (under the ball of the foot) that has room to fit a two-hole pedal cleat (usually called an SPD compatible cleat).

On the inner side of the sole, a threaded fastener for the cleat is provided, which includes two or more female threads; such fastener can usually slide fore and aft and slightly rotate so that, when the SPD compatible cleat is connected to the fastener by means of two (or more) screws, the mounted position of the cleat itself can be adjusted to user preference.

Since the shoe sole is intended for use on mountain bikes, the sole has a tread for walking traction and for properly interfacing with the pedal.

The bicycle pedal correspondingly includes an engagement mechanism that engages with the cleat, after the latter has been rigidly mounted to the sole of the cycling shoe.

The stability of the pedal/shoe interface depends on the pedal mechanism being engaged with the cleat, and simultaneously the pedal body contacting the tread of the sole that is adjacent to the cleat mount area.

As the tread wears, the pedal/shoe interface becomes more and more sloppy, and less and less desirable by the rider.

Many mountain bikers combine riding their bike with "hike a bike", which is carrying their bike over certain parts of a trail, and this usually causes significant tread wear.

With enough tread wear, the pedal/shoe interface becomes overly sloppy, and the shoe must be discarded even if it is in excellent conditions other than the tread that is directly adjacent to where the cleat is mounted.

Currently, there is no clear way for riders to know when their shoe tread has worn beyond its useful life.

Some prior art shoes have replaceable tread pieces, but they also include lots of fasteners holding down the many different tread pieces, so that the solution results in inferior tread, and too many screw heads are positioned where tread rubber would be preferred.

Generally, being clipped into a pedal enables the rider to both push and pull during pedal strokes, allowing the most possible power input and efficiency. However, sometimes riders chose not to be clipped into their pedal because of safety concern, or inability to clip into their pedal when first starting out from a standstill, or various other situations.

For example, many mountain bike riders occasionally want to traverse a difficult part of the trail, and the rider may prefer to be able to immediately remove their foot from their pedal without having to first twist out to disengage.

In other cases, riders place their foot on the center area of their shoe, so that they can apply weight to the pedal without risk of clipping into the cleat.

However, since clip-in pedals have a mechanism that protrudes above the pedal body, standing on the pedal means, for the rider, standing on the pedal mechanism and this is awkward, unstable and it can cause the shoe to inadvertently slip off the pedal.

When first starting out from a standstill—and with one shoe already clipped into one pedal—and especially when starting out up or downhill, it is often difficult, for the rider, to immediately clip into the other pedal; then the rider typically puts the middle area of his shoe onto the pedal, until an opportunity comes to clip into that pedal.

As mentioned above, this can be awkward, unstable, and cause the shoe to slip off the pedal.

SUMMARY OF THE INVENTION

The technical aim of the present invention is therefore to improve the state of the art in the field of mountain bike shoe soles.

Within such technical aim, it is an object of the invention to develop a mountain bike shoe sole which allows to obviate the drawbacks previously complained.

Another object of the present invention is to develop a mountain bike shoe sole which allows to preserve optimal pedal/shoe interface conditions for a long time, in terms of safety and stability.

A further object of the present invention is to realize a mountain bike shoe sole which allows the rider to constantly check the wear conditions of the tread of the outsole.

Still another object of the present invention is to develop a mountain bike shoe sole which allows the rider to safely and effectively pedal even without the cleat of the outsole being engaged in the clipping mechanism of the pedal.

Another object of the present invention is to implement a mountain bike shoe sole which allows the rider to safely and effectively pedal even when he chooses not to clip the shoe sole into the pedal because of safety concern, or in situations in which it is impossible to engage the cleat into the clipping mechanism of the pedal.

A further object of the present invention is to devise a mountain bike shoe sole which allows achieving the foregoing objects with a technical solution which is constructively simple and inexpensive.

This aim and these objects are all achieved by a mountain bike shoe sole according to the present application.

The mountain bike shoe sole comprises an outsole, having a lower surface and a tread, at least a recess, provided in the lower surface, for housing a cleat assembly, and at least a removable shim, housed in the recess, suitable to be interposed between the lower surface of the outsole and the cleat assembly.

According to a further aspect of the invention, the mountain bike shoe sole includes an alternative pedal placement zone behind the cleat area, to fit the pedal clipping mechanism without clipping it, to provide improved pedal/shoe stability and security when not clipped into the pedal.

According to still another aspect of the invention, the mountain bike shoe sole includes a tread wear indicator built into the tread.

The shim, which is used when the shoe is new, is later removed when tread wear has caused excessive pedal/shoe interface play.

More in detail, the shoe sole according to the invention includes an outsole, a shim and a threaded fastener.

The outsole has a semi-rigid structure, and it includes a resilient tread.

On the inner side of the sole, the threaded fastener has two female threads, and it can slide fore and aft and it can slightly rotate, so that, when fastened together with two screws, the mounted position of an SPD compatible cleat can be positioned to user preference.

As stated, the outsole has a recess for the shim; when new, the distance between the top of the shim and the top of the support tread on either side of the recess is the proper amount to support the body of a clipped-in pedal.

According to another aspect of the invention, the outsole includes a wear indicator of the wear of the outsole.

The wear indicator includes a top layer, provided in the support tread, which is made of a different color (and matching the color of the shim), and whose depth is approximately the same as the shim's thickness.

Beneath this top layer a bottom layer is provided, whose color matches the color of the surface of the sole below the shim.

In this way, when the top layer tread wear indicator wears enough to show the bottom layer color, the rider knows it is time to remove the shim to improve the shoe/pedal interface fit.

When the bottom layer tread wear indicator wears completely, it is time to replace the whole shoes.

According to still another aspect of the invention, the outsole includes an alternative pedal placement zone that is behind the cleat area.

This zone is for improved placement of the shoe when the rider chooses not to clip into the cleat (or when he temporarily cannot clip into the cleat).

This zone includes contours to fit the pedal clipping mechanism, so that the shoe cannot inadvertently slip off the pedal: the shoe is consistently positioned on the pedal, and comfort is improved.

There are other contours in the tread so that the pedal body can fit close enough to the sole, to allow the pedal mechanism to fit properly into the zone: in this way, pedals with bodies of widely varying sizes can properly fit the zone.

While the shoe sole according to the preferred embodiment of the invention includes a single shim, in other embodiments according to the invention the shoe sole may include two or more shims and corresponding tread wear indicator portions.

Also, while in the preferred embodiment of the invention the sole includes contours that ideally fit a brand of mountain bike pedal, there could be alternative zone contours for fitting other brand/types of mountain bike pedals.

In some embodiments of the invention, the outsole may include replaceable zone structures in order, for one sole, to fit a wider variety of brands/types of pedals.

BRIEF DESCRIPTION OF THE DRAWINGS

These and other advantages will be better understood by any man skilled in the art from the following description that follows and from the attached drawings, given as a non-limiting example, in which.

DETAILED DESCRIPTION OF THE INVENTION

Figure 1:
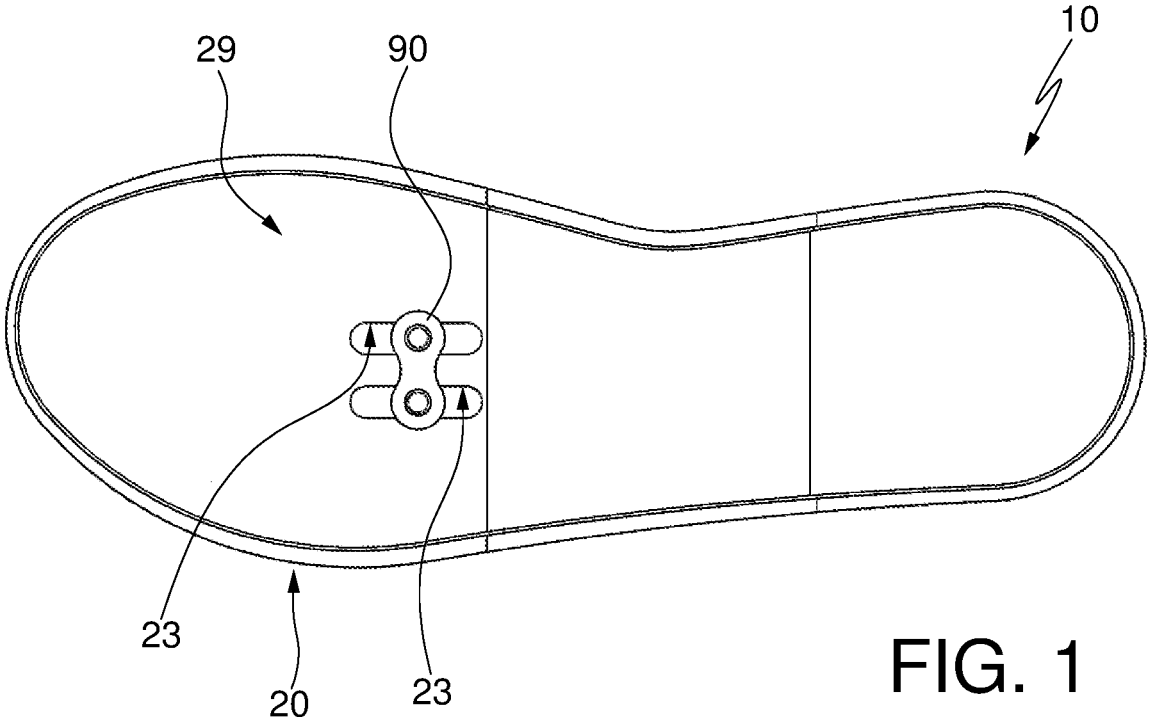
FIG. 1 is a top view of the mountain bike shoe sole according to the invention.
Figure 2:
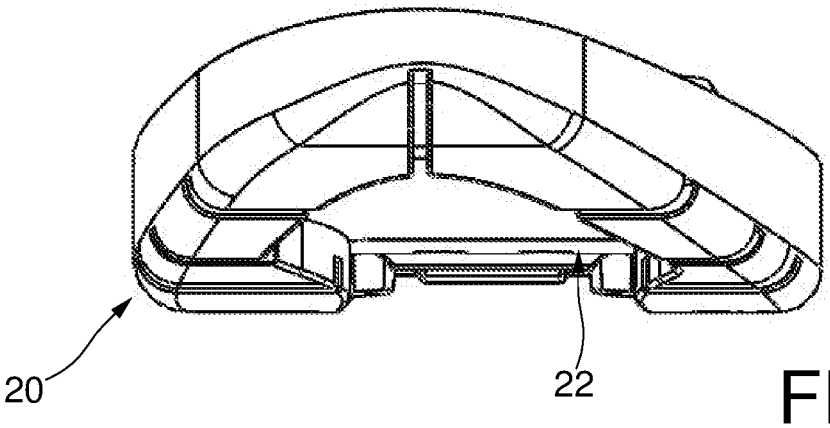
FIG. 2 is a front view of the mountain bike shoe sole.
Figure 3:
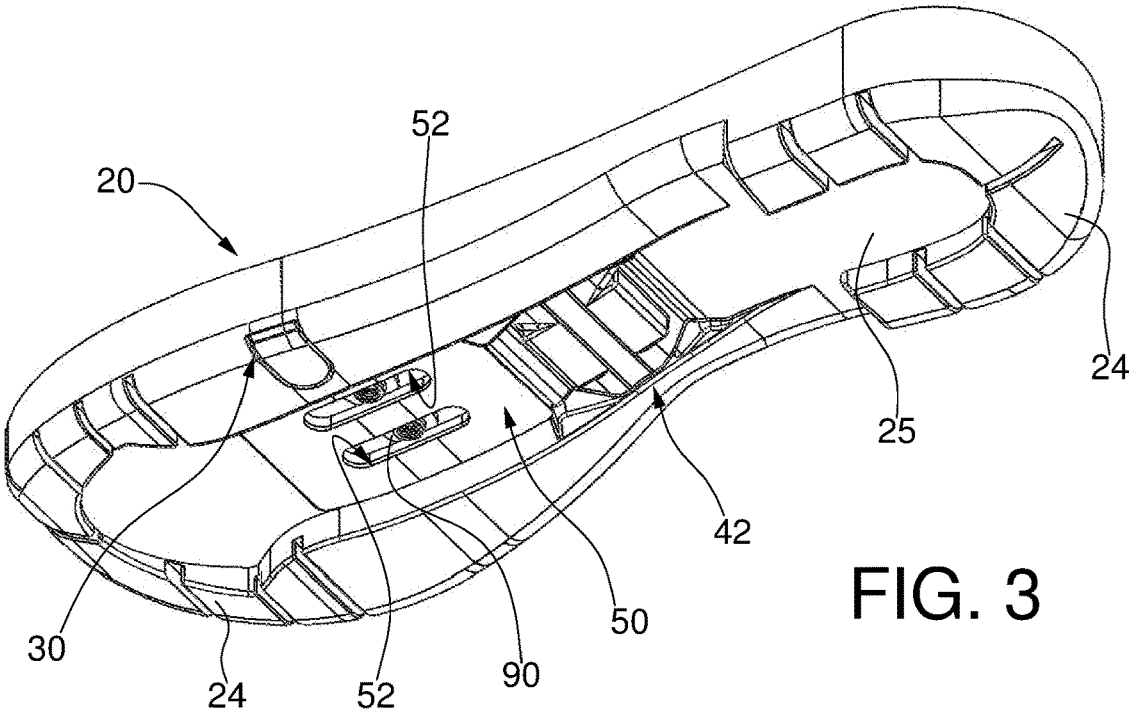
FIG. 3 is a perspective view of the mountain bike shoe sole according to the invention.

With reference to FIG. 1, a mountain bike shoe sole according to the invention is wholly indicated with 10.

The sole 10 includes, more in detail, an outsole 20.

The sole 10 may also include a cleat assembly 120; however, the cleat assembly is not necessarily included in the sole 10.

The cleat assembly 120 is a typical mountain bike cleat system.

The cleat assembly 120 includes a cleat 60, and fixing members 62 for fixing the cleat 60 to the outsole 20.

The shape and features of the cleat 60 may be any, all within the scope of the present invention.

The fixing members 62 include a washer 70, two screws 80, and a threaded fastener 90.

The threaded fastener 90 is associated, in use, to the upper surface 29 of the outsole 20.

The remaining parts of the cleat assembly 120 (cleat 60, washer 70 and screws 80) are associated, in use, to the lower surface 21 of outsole 20.

Outsole 20 includes a structure 25; structure 25 is semi-rigid.

Outsole 20 further includes a resilient tread 24, provided in the lower portion of the structure 25.

According to an aspect of the invention, the sole 10 further includes at least a removable shim 50.

As better disclosed hereafter, in use the removable shim 50 is arranged between the lower surface 21 of the outsole 20 and the cleat 60.

The shim 50 can be quickly and easily removed from the sole 10 (i.e. from the outsole 20) when the wear of the resilient tread 24 is equal to, or greater of, a certain entity.

According to another aspect of the invention, the outsole 20 includes at least a wear indicator 30.

The wear indicator 30 allows the ruder to ascertain and check the above cited magnitude of the resilient tread wear 24.

More in detail, the wear indicator 30 visually warns the user, in a very fast and intuitive way, that the shim 50 must be removed, to improve/restore the proper shoe/pedal interface fit.

According to a further aspect of the invention, outsole 20 includes an alternative pedal placement zone 42.

As better explained hereafter, the word "alternative" used in the present description means that the rider can place the bicycle pedal also in such zone 42, instead of the cleat assembly 120 zone, at his choice.

Such zone 42 is for improved placement of the shoe when the rider chooses not to (or temporarily cannot) clip into the cleat assembly 120.

Outsole 20 includes, along its lower surface 21, a recess 22.

The recess 22 is provided in the forward centre part of the outsole 20 (i.e. under the ball of the foot), where the cleat assembly 120 can be secured.

The outsole 20 includes, along the recess 22, two first slots 23; first slots 23 are parallel, and they extend substantially along the front-rear direction of the outsole 20.

The first slots 23 allow securing the cleat assembly 120 to the outsole 20. In the rear and front ends of the outsole 20, tread 24 provides the required traction when walking.

Tread 24 further includes, in the central portion of the outsole 20, two lateral support treads 36,37, adjacent to the recess 22; the support treads 36,37 provide support to the pedal body when pedal 100 is clipped into the cleat 60.

More in detail, the tread 24 includes an outer support tread 36 and an inner support tread 37.

The shim 50 includes two second slots 52; second slots 52 are parallel and, in use, they substantially extend along the front-rear direction of the outsole 20.

In use, when the cleat 60 is mounted on the outsole 20, the second slots 52 of the shim 50 match the first slots 23 of the outsole 20, allowing the cleat 60 to be arranged in the position preferred by the user (i.e. to be moved fore and aft at user's choice).

The second slots 52 allow the passage of the screws 80 for fixing the cleat 60 to the thread fastener 90.

The shim 50 fits into the recess 22 in such a way to be interposed, in use, between the lower surface 21 of the outsole 20 and the cleat 60.

The shim 50 includes relief portions 54, to securely engage the recess 22; the recess 22 correspondingly includes seats 28 for housing said relief portions 54.

Figure 4:
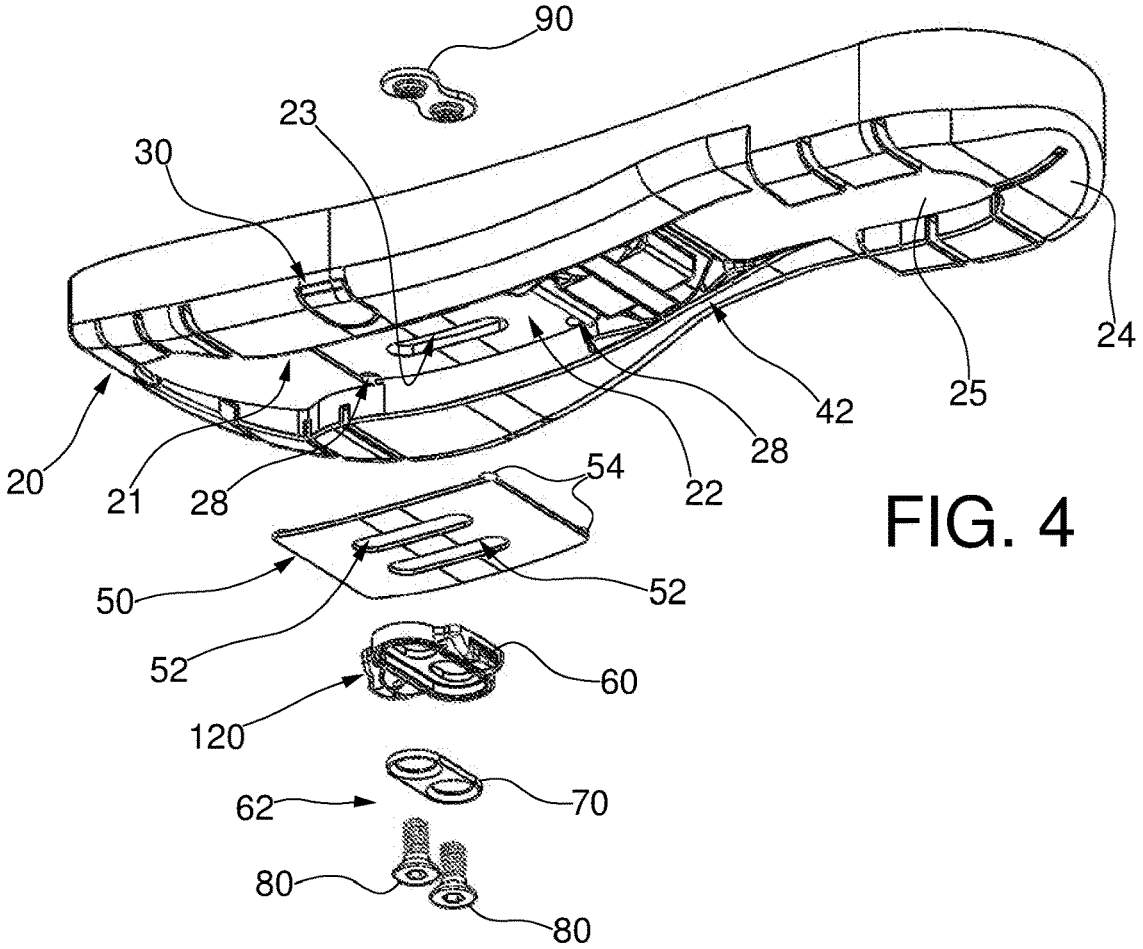
FIG. 4 is an exploded perspective view of the mountain bike shoe sole including a cleat assembly.
Figure 5:
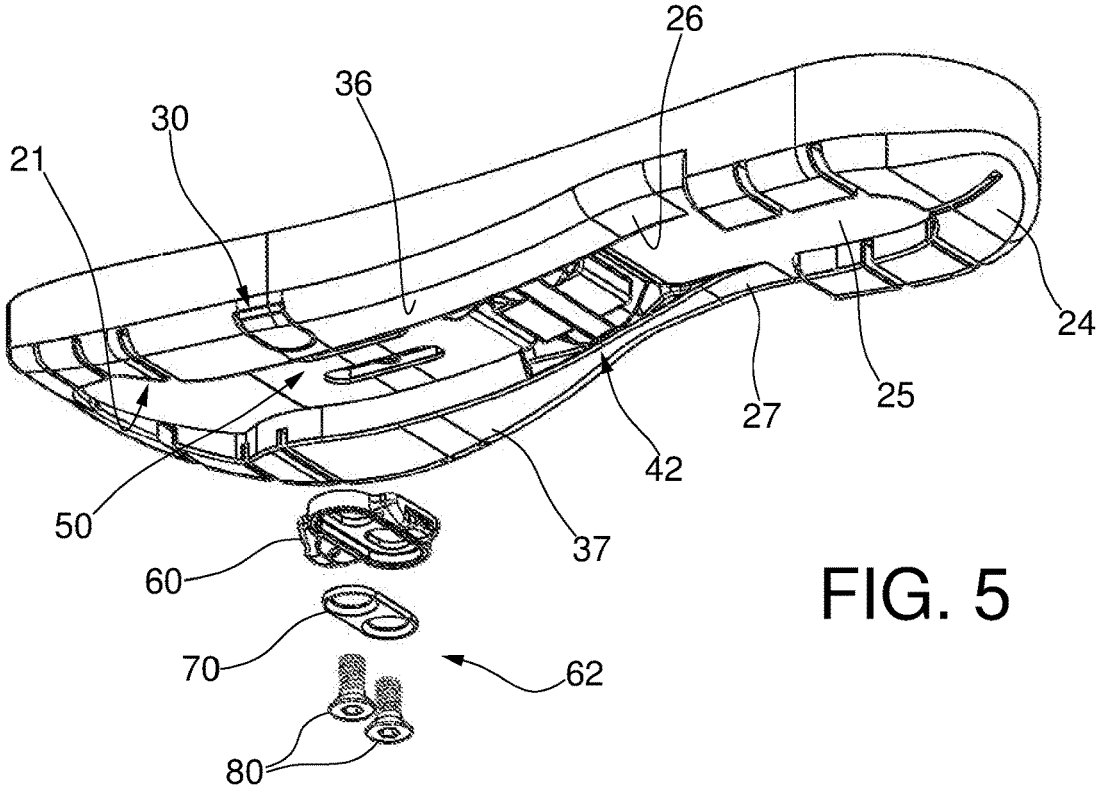
FIG. 5 is a perspective view of the mountain bike shoe sole with the cleat assembly exploded.
Figure 6:
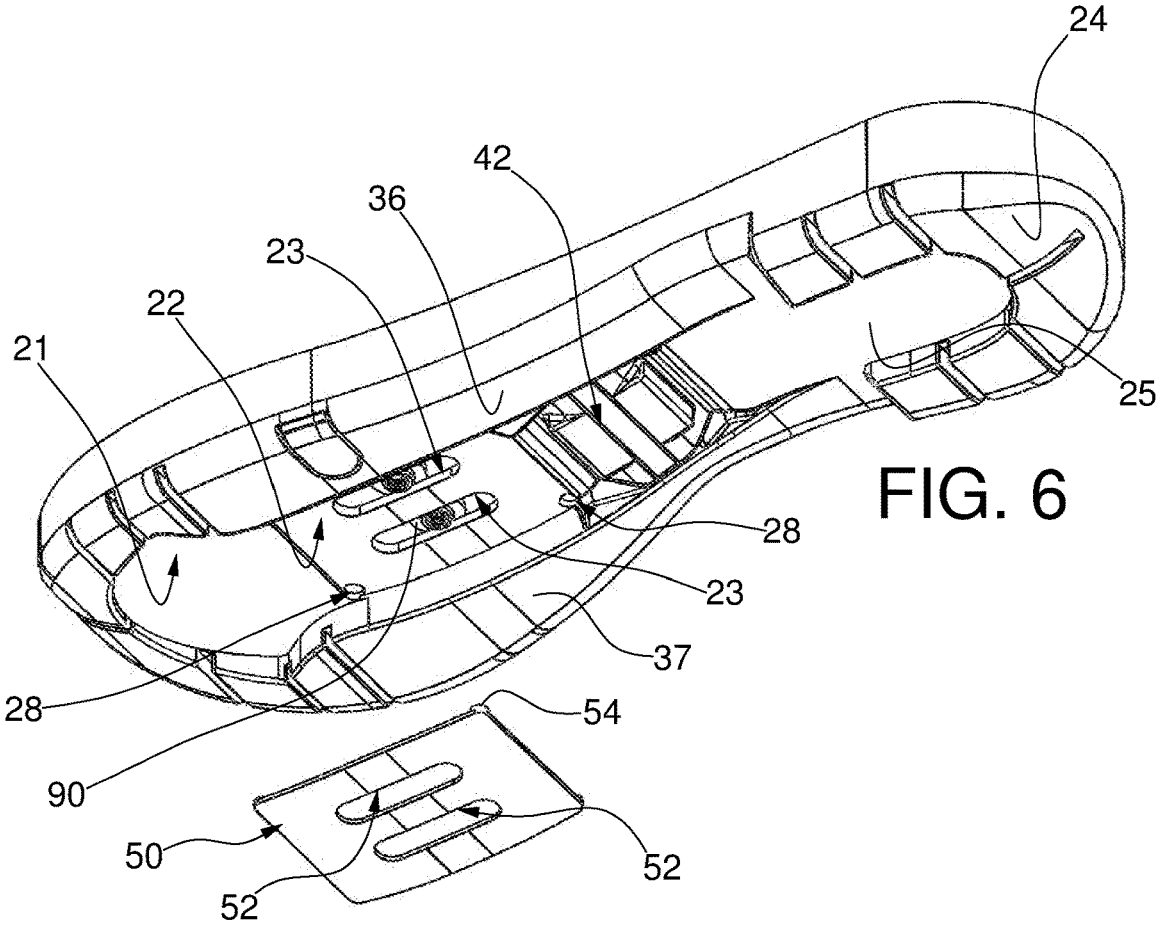
FIG. 6 is a perspective view of the mountain bike shoe sole with the shim exploded.
Figure 7:
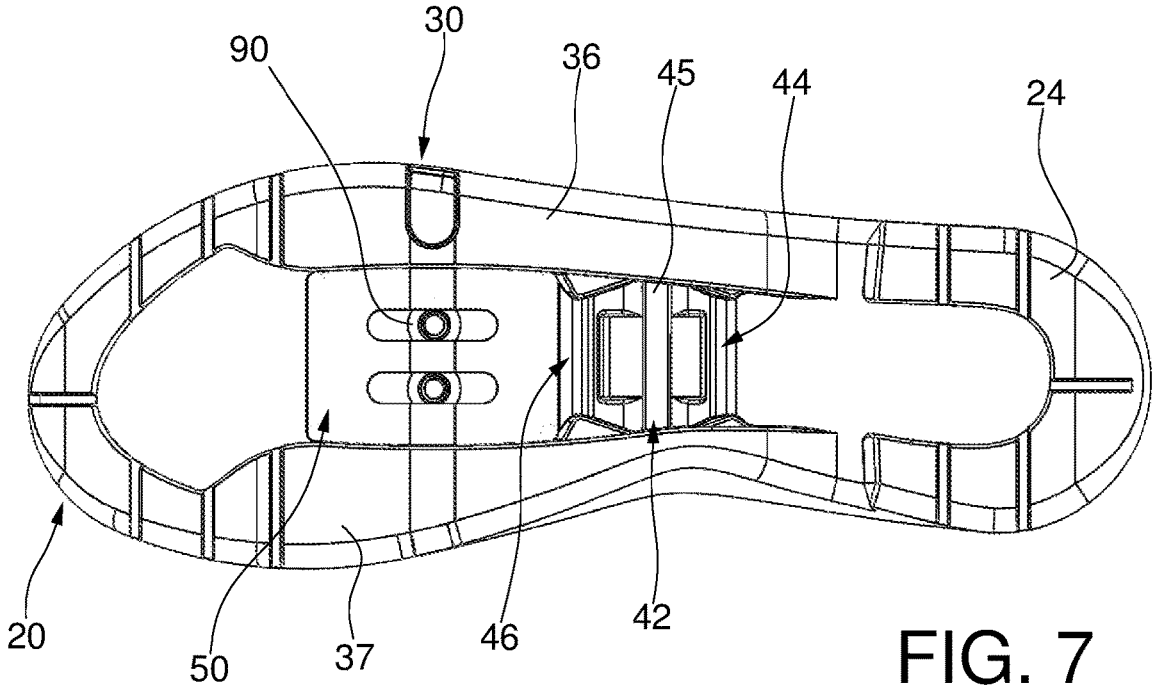
FIG. 7 is a bottom view of the mountain bike shoe sole.

More in detail, the relief portions 54 are provided by the corners of the shim 50; correspondingly, the seats 28 are provided by the corners of the recess 22 (see for example FIGS. 4,6).

In other embodiments of the invention, relief portions 54 and seats 28 could be provided, respectively, in other areas of the shim 50 and recess 22, in relation to specific application or design requirements.

In use, the cleat 60 is fixed to the outsole 20 by the screws 80 passing through the washer 70, the cleat 60 itself, the first slots 23 of the outsole 20, the second slots 52 of the shim 50, and finally engaging the threaded fastener 90 (see FIG. 4).

The wear indicator 30 is provided along at least one of the support treads 36,37 of the outsole 20.

For example, in the embodiment of the invention which is shown in the figures, the wear indicator 30 is provided along the outer support tread 36 of the outsole 20.

In other embodiments of the invention, the wear indicator 30 could be provided along the inner support tread 37, or it could be provided along both the outer support tread 36 and the inner support tread 37.

Figure 10:
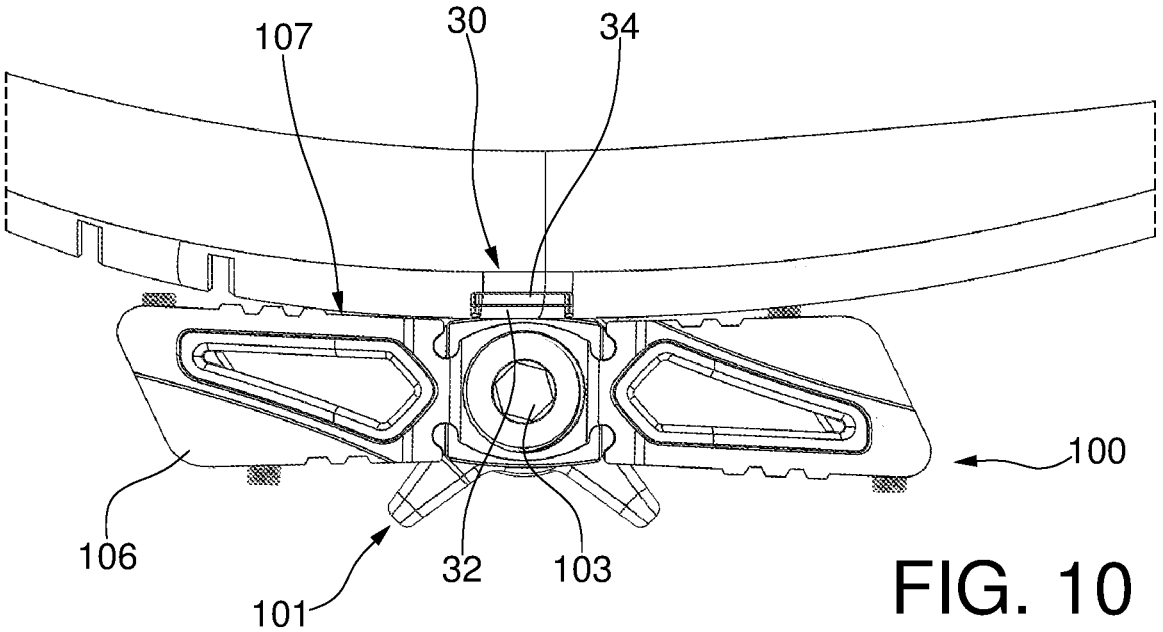
FIG. 10 is a close-up view of FIG. 9.
Figure 11:
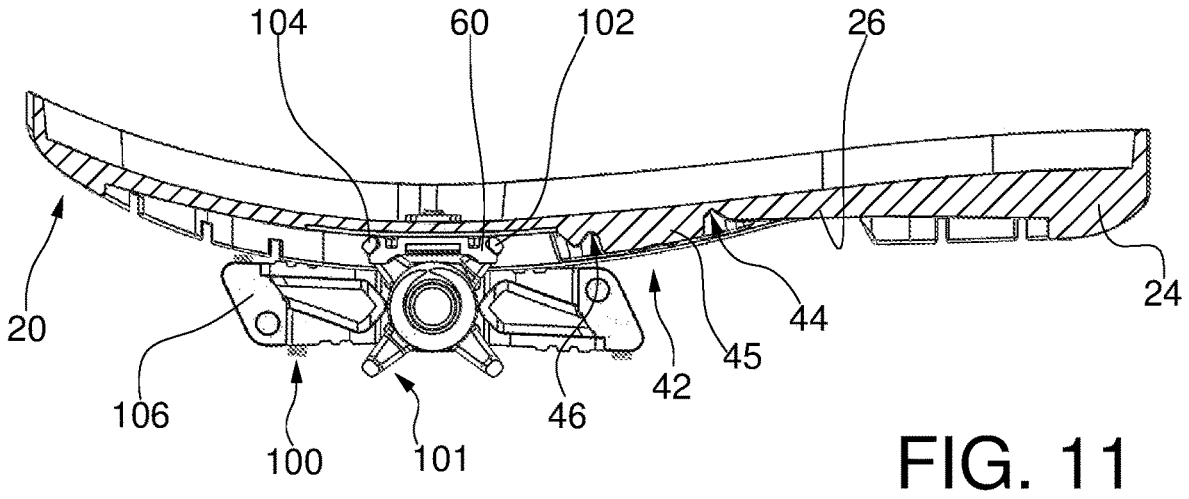
FIG. 11 is a side sectional view of the mountain bike shoe sole with the pedal clipped into the cleat.

Referring now in particular to FIG. 10, the wear indicator 30 includes a top layer 32 and a bottom layer 34.

According to an aspect of the invention, the top layer 32 has substantially the same thickness of the shim 50.

According to another aspect of the invention, the colour of the top layer 32 matches the colour of the shim 50.

This means that when the top layer 32, after some use, is not completely worn yet, the shim 50 should not be removed from the outsole 20.

According to a further aspect of the present invention, the colour of the bottom layer 34 matches the colour of the surface of the outsole 20 below the shim 50.

According to the invention, when the top layer 32 wears out—therefore exposing the bottom layer 34—the shim 50 should be discarded, i.e. removed from the outsole 20: this will cause the shoe/pedal interface to be optimal just like new, with maximum stability between shoe and clipped in pedal.

In fact, the pedal body 106 (see FIGS. 9-12) makes optimum contact with the support treads 36,37 of the outsole 20.

Figure 13:
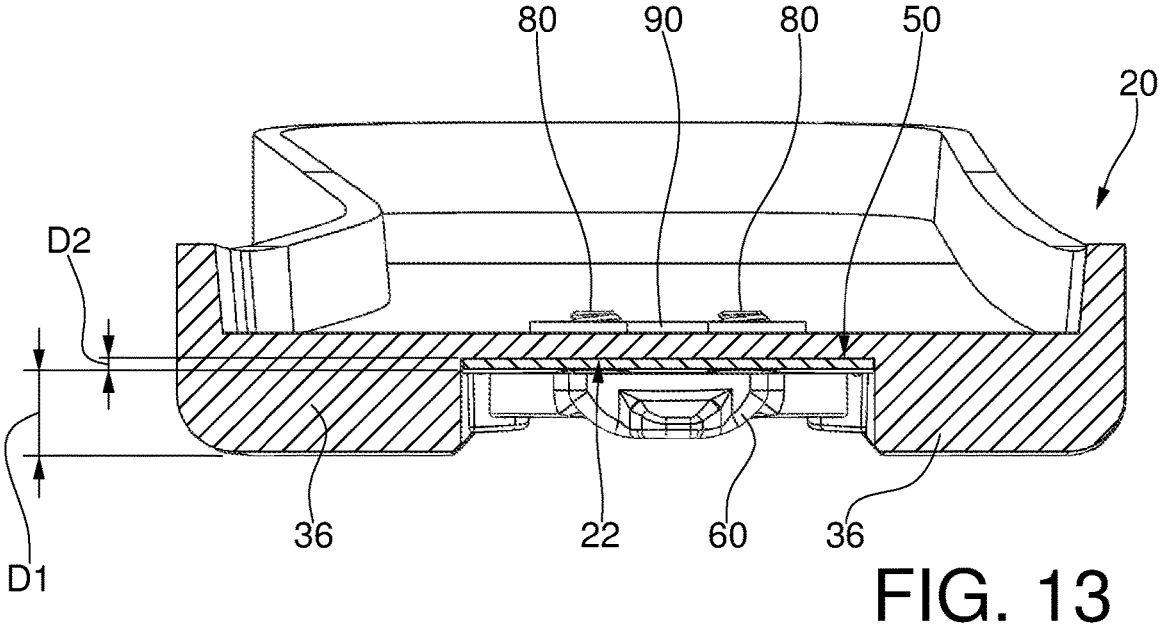
FIG. 13 is a front sectional view of the mountain bike shoe sole with a cleat mounted.

For a better understanding of the features of the inventions, FIG. 13 shows a front sectional view of the shoe sole 10 with the cleat 60 mounted.

Distance D1, which represents the cleat 60 depth within the outsole 20, is an important parameter to provide ideal pedal/shoe interface contact and stability. In fact, when support treads 36,37 wear by an amount equal to, or greater than, the shim thickness D2, then the shim 50 should be removed: this will restore, in the outsole 20, the cleat 60 depth to its original dimension (distance D1), which will make the pedal/shoe interface contact ideal again.

Figure 14:
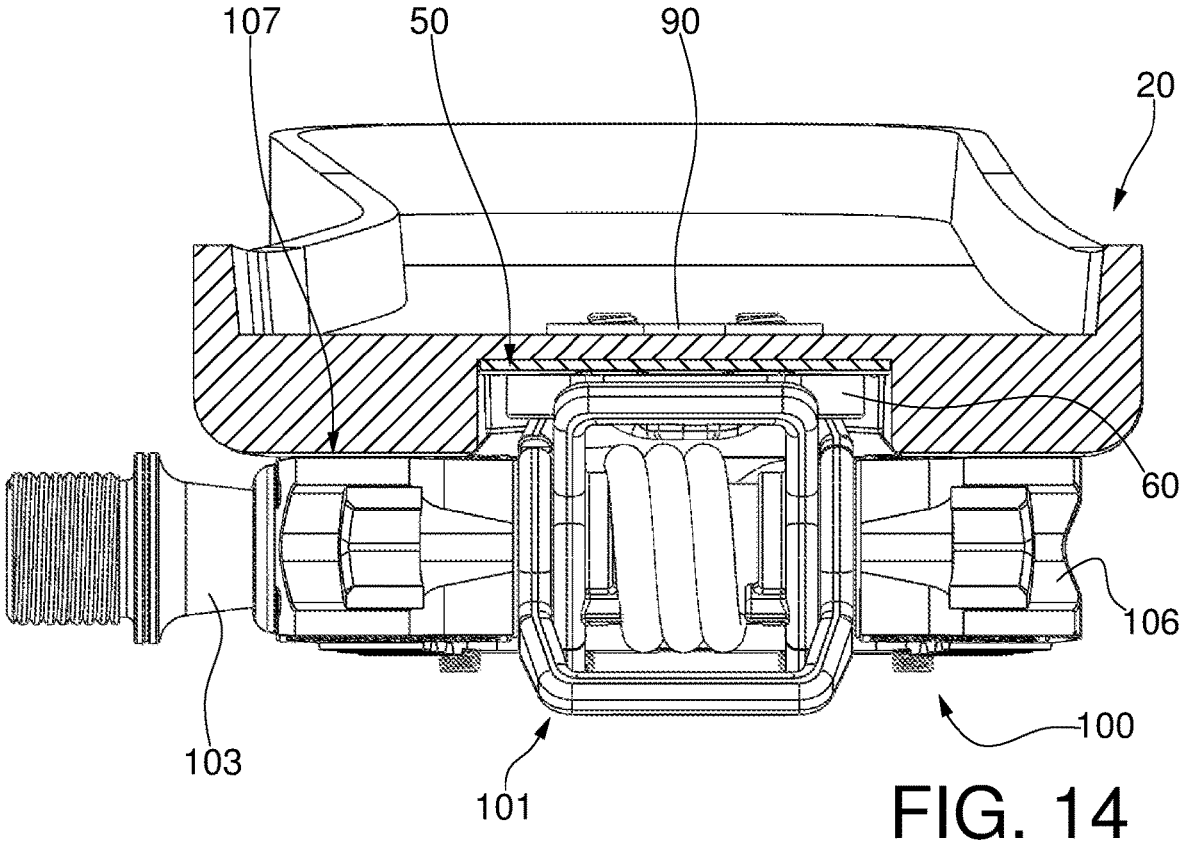
FIG. 14 is a front sectional view of the mountain bike shoe sole with a cleat mounted and a pedal clipped into the cleat.

FIG. 14 shows a front sectional view of the shoe sole 10 with the cleat 60 mounted, and the pedal 100 clipped into the cleat 60: the pedal tread supports 107 contact the tread supports 36,37 of the outsole 20.

The pedal body 106 of the pedal 100 includes, in its upper portion, a clipping mechanism 101.

The clipping mechanism 101 includes clipping portions 102,104 which, in use, engages the cleat 60 and allows safe connection between the outsole 20 and the pedal body 106.

FIG. 14 demonstrates how pedal/shoe interface depends on the contact between the pedal body 106 and the support treads 36,37 of the outsole 20, because the clipping mechanism 101 hooked to the cleat 60 cannot, alone, create a stable interface.

Therefore, as the support treads 36,37 of the outsole 20 wear because of walking with the shoe, the pedal/shoe interface becomes increasingly loose.

This drawback is completely resolved by the technical solution according to the present invention.

While the disclosed embodiment of the shoe sole 10 according to the invention includes one shim 50 interposed between the outsole 20 and the cleat 60, other embodiments of the invention may include more shims 50, superimposed over each other, for example having altogether the same overall thickness.

A shoe sole 10 including a certain number of removable shims 50—with the same overall thickness—allows the rider to constantly restore the optimal pedal/shoe interface conditions, as the tread 24 of the outsole progressively wears. More in general, the rider could choose the thickness of the removable shim 50 (or of the plurality of removable shims 50) in order to properly adjust the pedal/shoe interface at his own discretion.

According to a further aspect of the present invention, the alternative pedal placement zone 42 is provided to the rear of the cleat assembly 120.

More in detail, the alternative pedal placement zone 42 is provided to the rear if the shim 50.

The alternative pedal placement zone 42 includes one or more contours 44,46.

The contours 44,46 are suitable to engage the clipping portions 102,104 of the clipping mechanism 101 of the pedal 100.

Therefore, the contours 44,46 are shaped and arranged in relation to the shape, dimensions and arrangement of the clipping portions 102,104.

In the specific embodiment of the invention shown in the figures, the clipping portions 102,104 includes two bars, more particularly two spring loaded bars 102,104.

The bars 102,104 are parallel to the axis of the pedal spindle 103.

Therefore, in the embodiment shown in the figures, the alternative pedal placement zone 42 includes two contours 44,46 suitable to engage, respectively, the two clipping portions 102,104 of the clipping mechanism 101 (i.e. the two bars 102,104 of the clipping mechanism 101).

For this reason, the two contours 44,46 are parallel, and arranged transversely with respect to the front-rear direction of the outsole 20.

In other words, in use and when the rider is pedalling, the contours 44,46 are parallel to the axis of the pedal spindle 103.

The distance between the two contours 44,46 depends on the distance between the two clipping portions 102,104 of the clipping mechanism 101.

Figure 8:
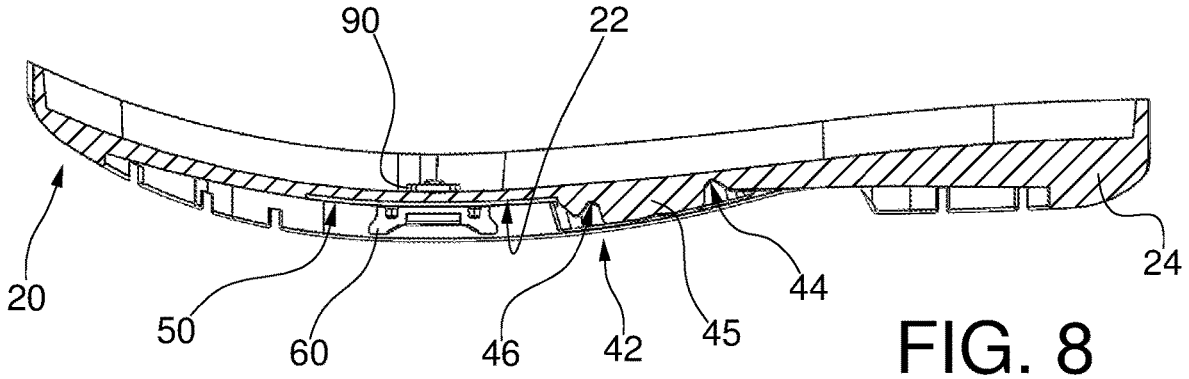
FIG. 8 is a side sectional view of the mountain bike shoe sole.
Figure 9:
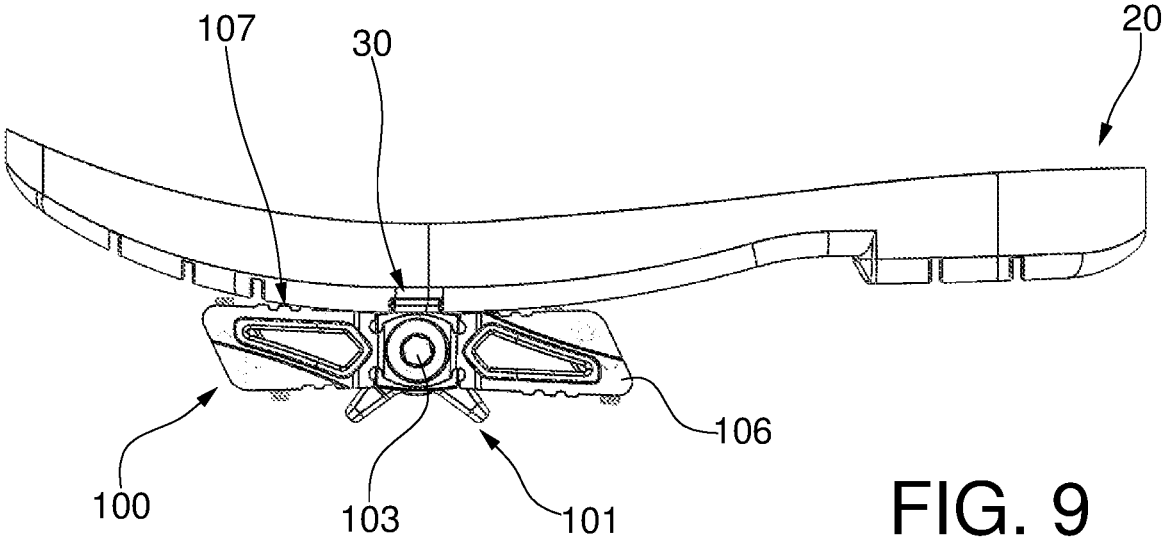
FIG. 9 is a side view of the mountain bike shoe sole with the pedal clipped into the cleat.
Figure 12:
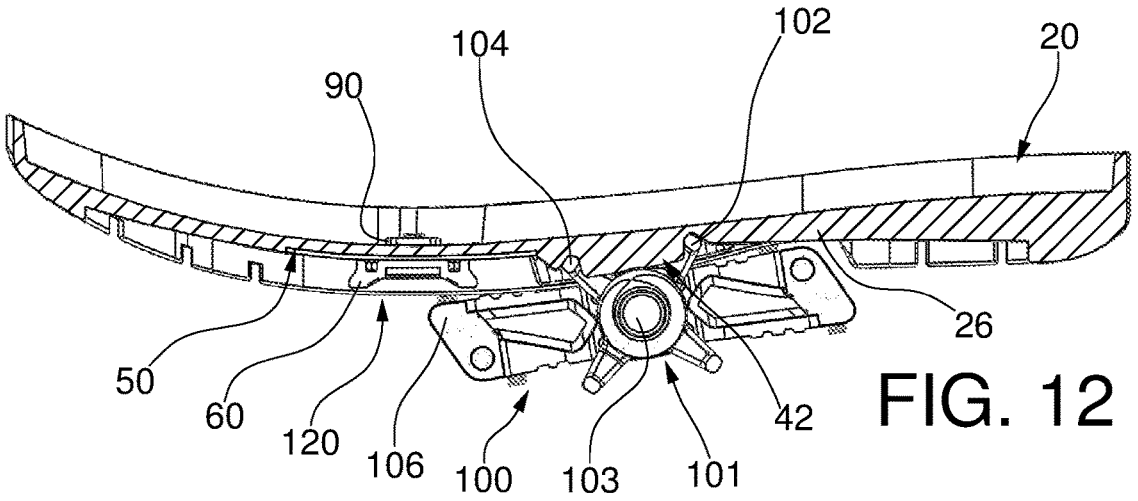
FIG. 12 is a side sectional view of the mountain bike shoe sole with a pedal fit into the alternative pedal placement zone.

Also, the cross section of the contours 44,46—see for example FIG. 8 and FIG. 12—depends on the shape and features of the clipping portions 102,104.

In the embodiment shown in the figures, the cross section of the contours 44,46 fits the cross section of the clipping portions 102,104, which is essentially rectangular with rounded corners.

In other embodiments of the invention, the cross section of the contours 44,46 may have any other suitable shape to properly fit the cross section of the clipping portions 102, 104, which obviously may vary from pedal to pedal.

According to a further aspect of the invention, the outsole 20 conforms an embossed area 45 between the two contours 44,46, as shown for example in FIG. 8.

The embossed area 45 facilitates, in use, the stable engagement of the clipping portions 102,104 into the contours 44,46; more particularly, the embossed area 45 prevents the clipping portions 102,104 from slipping outside the contours 44,46.

Therefore, in use, the shoe sole 10 will not inadvertently slip off pedal 100 because the clipping portions 102,104 are firmly fit into the alternative pedal placement zone 42; more in particular, the clipping portions 102,104 are firmly fit into the respective contours 44,46 of the alternative pedal placement zone 42.

In this way, the rider can pedal with confidence and safety even when the clipping mechanism 101 is not clipped into the cleat 60.

According to another aspect of the invention, the support treads 36,37 include respective portions with reduced height 26,27.

Portions with reduced height 26,27 provide clearance for the pedal body 106 when it is positioned in the alternative pedal placement zone 42, as shown in FIG. 12.

The portions with reduced height 26,27 provide clearance for the pedal body 106 even for larger platform pedal bodies 106.

More in detail, the portions with reduced height 26,27 provide clearance for the pedal body 106 to allow the clipping portions 102,104 to fully fit into the respective contours 44,46 of the alternative pedal placement zone 42.

Figure 15:
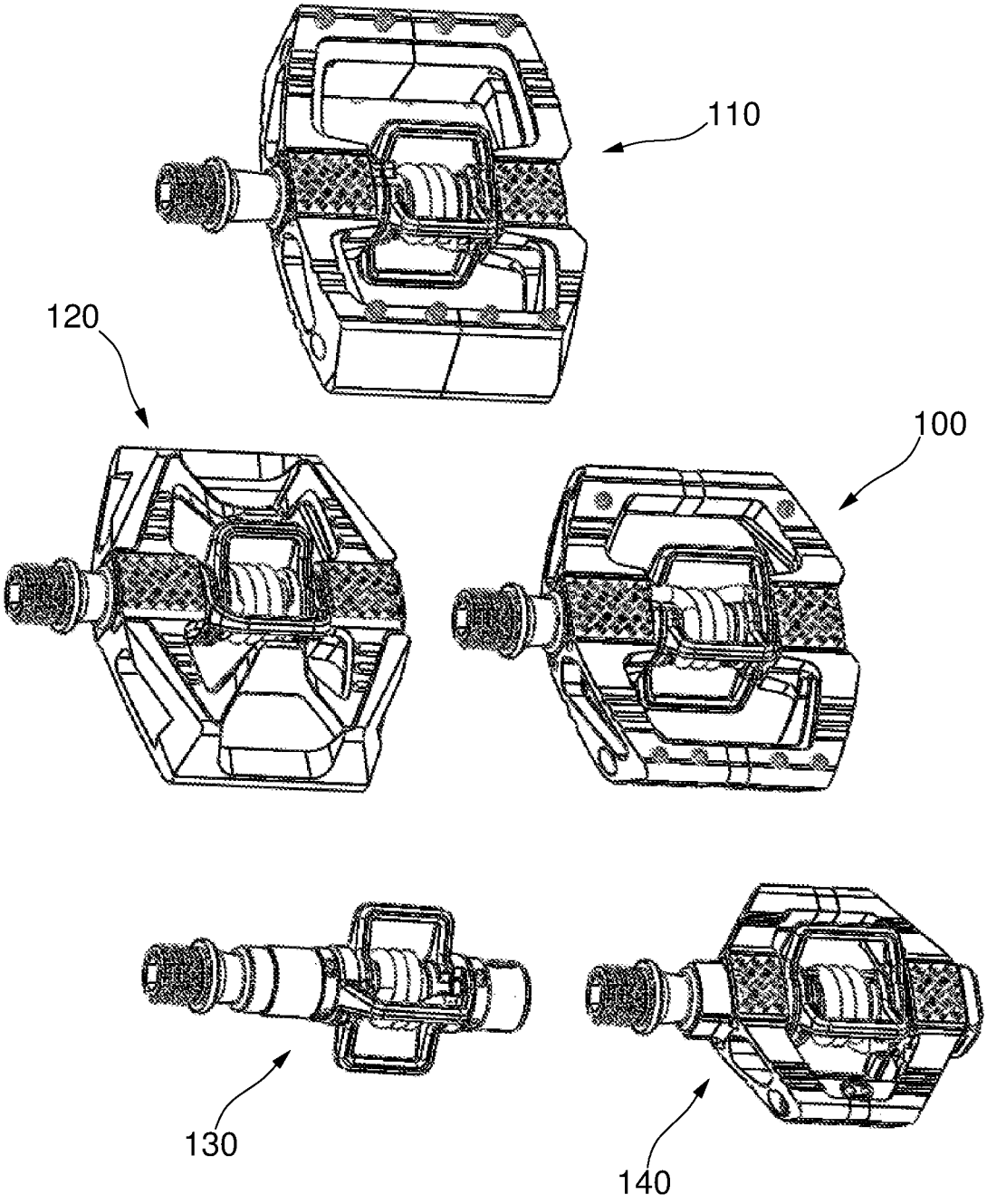
FIG. 15 is a perspective view of a variety of different mountain bike pedals, all suitable for use with the shoe sole according to the present invention.

FIG. 15 shows a perspective view of a variety of different mountain bike pedals 100,110,120,130,140.

The mountain bike pedals 100,110,120,130,140 shown in FIG. 15 vary significantly in size and style: nevertheless, all of them properly clip into the shoe sole 10 according to the present invention, and all of them also properly fit the alternative pedal placement zone 42 of the same shoe sole 10.

All mountain bike pedals 100,110,120,130,140 have the same shoe/pedal interface issues previously discussed; they share the same kind of clipping mechanism 101.

Other kind of mountain bike pedals, not shown in the figures, including substantially different clipping mechanisms 101, would require a different cleat 60, and a differently shaped alternative pedal placement zone 42, which would nevertheless fall within the same inventive concept of the present invention.

In other words, the alternative pedal placement zone 42 of the shoe sole 10 according to the present invention essentially needs to include contours 44,46 that fit the intended pedal clipping mechanism 101, i.e. the intended clipping portions 102,104.

It is a further object of the present invention a method for adjusting the pedal/shoe interface of a mountain bike shoe sole 10.

The method includes a step of providing a shoe sole 10 including an outsole 20 and a recess 22 for a cleat assembly 120 to be fixed to the outsole 20, wherein the outsole 20 includes a wear indicator 30 of the thread 24 of the outsole 20; the shoe sole 10 further includes at least a shim 50, suitable to be interposed between the cleat assembly 120 and the lower surface 21 of the outsole 20.

In use, as the cleat assembly 120 is fixed to the sole 10, the method further includes a step of disassembling the cleat assembly 120 from the sole 10 as the wear indicator 30 indicates that the wear of the thread 24 is equal to, or greater than, a certain entity.

After that, the method includes a step of removing the shim 50 (or at least a shim 50, if there is more than one).

After removal of the shim 50, the cleat assembly 120 can be reassembled on the outsole 20 (in particular into the recess 22).

In the method according to the present invention, the features of the outsole 20 and of the cleat assembly 120—which is not necessary included in the sole 10 according to the invention—are those already disclosed previously.

In another embodiment of the invention, the mountain bike shoe sole 10 comprises an outsole 20 having a tread 24.

The sole 10 further includes at least a wear indicator 30 of the wear of the tread 24, suitable to indicate to the user that the wear of the tread 24 is equal to, or greater than, a certain entity.

More in detail, the tread 24 of the outsole 20 includes, in the central portion of the outsole 20, two lateral support treads 36,37; the wear indicator 30 is provided along the outer support tread 36, and/or along the inner support tread 37.

Preferably, the wear indicator is provided in the outer support tread 36.

The wear indicator 30 includes a top layer 32 and a bottom layer 34.

The top layer 32 is of a first color, and the bottom layer 34 is of a second color; the first color and the second color are different from the color of the tread 24.

In still another embodiment of the invention, the mountain bike shoe sole 10 comprises an outsole 20 having a tread 24, and a recess 22 for housing a cleat assembly 120.

The sole 10 further includes at least an alternative pedal placement zone 42, provided in the outsole 20 to the rear of the recess 22 suitable for housing the cleat assembly 120.

The alternative pedal placement zone 42 includes one or more contours 42,44, suitable to engage the clipping portions 102,104 of the clipping mechanism 101 of the pedal 100 of the mountain bike.

More in detail, the alternative pedal placement zone 42 includes two contours 44,46 which are parallel, and arranged transversely with respect to the front-rear direction of the outsole 20.

The outsole 20 conforms an embossed area 45 between the two contours 44,46, which prevents the clipping portions 102,104 of the pedal 100 from slipping outside the contours 44,46.

The tread 24 of the outsole 20 includes, in the central portion of the outsole 20, two lateral support treads 36,37; such support treads 36,37 include respective portions with reduced height 26,27, which provide clearance for the pedal body 106 when the latter is positioned in the alternative pedal placement zone 42.

In the embodiments of the inventions previously disclosed individual features, given in connection with such specific embodiments, may actually be interchanged with other different features that exist in other embodiments.

The present invention has been described according to preferred embodiments, but equivalent variants can be devised without departing from the scope of protection offered by the following claims.

The invention claimed is:

1. A mountain bike shoe sole, comprising:

an outsole having a central portion, a lower surface and a tread;

a cleat assembly;

at least a recess, provided in said lower surface, for housing said cleat assembly;

at least a removable shim, housed in said recess, having a thickness, and being suitable to be interposed between said lower surface of said outsole and said cleat assembly, wherein said outsole includes at least a wear indicator;

wherein said tread of said outsole includes, in said central portion, an outer support tread and an inner support tread, said wear indicator being provided along said outer support tread, and/or along said inner support tread; and wherein said wear indicator includes a top layer, having a thickness which is substantially equal to said thickness of said shim, and a bottom layer.

2. The mountain bike shoe sole according to claim 1, wherein said shim includes relief portions to securely engage said recess, said recess correspondingly including seats for housing said relief portions.

3. The mountain bike shoe sole according to claim 2, wherein said shim and said recess include corners, said relief portions are provided by said corners of said shim, and correspondingly said seats are provided by said corners of said recess.

4. The mountain bike shoe sole according to claim 1, wherein said outsole includes, along said recess, two first slots, and wherein said shim includes two second slots which in use match said first slots.

5. The mountain bike shoe sole according to claim 1, wherein said top layer and said shim have respective colors, and wherein the color of said top layer matches the color of said shim.

6. The mountain bike shoe sole according to claim 5, wherein said outsole includes a surface, below said shim, having a color, and wherein said bottom layer have a color, and wherein said color of said bottom layer matches said color of said surface.

7. The mountain bike shoe sole according to claim 1, wherein said recess has a rear, and wherein said outsole includes at least an alternative pedal placement zone, provided to said rear of said recess.

8. The mountain bike shoe sole according to claim 7, wherein said outsole has a front-rear direction, and wherein said alternative pedal placement zone include two contours which are parallel, and arranged transversely with respect to said front-rear direction.

9. The mountain bike shoe sole according to claim 8, wherein said outsole conforms an embossed area between said two contours.

10. The mountain bike shoe sole according to claim 7, wherein said outer support tread and said inner support tread include respective portions with reduced height.

11. A combination of a mountain bike shoe sole and a pedal, wherein said sole includes:

an outsole having a front rear-direction, a lower surface and a tread;

a cleat assembly including a cleat;

at least a recess, provided in said lower surface, for housing said cleat assembly, said recess having a rear; and at least an alternative pedal placement zone provided in said outsole to said rear of said recess, wherein said pedal includes a pedal body having an upper portion, wherein said upper portion includes a clipping mechanism including clipping portions which, in use, engage said cleat, wherein said alternative pedal placement zone includes two contours which are parallel, and arranged transversely with respect to said front-rear direction of said outsole, suitable to engage said clipping portions, and wherein said outsole conforms an embossed area between said two contours which prevents said clipping portions from slipping outside said contours.

12. The combination according to claim 11, wherein said outsole includes a central portion, and wherein said tread includes, in said central portion, two lateral support treads, said support treads including respective portions with reduced height which provide clearance for said pedal body when said pedal body is positioned in said alternative pedal placement zone.

* * * * *